US008428284B2

(12) United States Patent
Meyer et al.

(10) Patent No.: US 8,428,284 B2
(45) Date of Patent: Apr. 23, 2013

(54) LOUDSPEAKER WITH PASSIVE LOW FREQUENCY DIRECTIONAL CONTROL

(75) Inventors: John D. Meyer, Berkeley, CA (US); Jean Pierre Mamin, La Tour de Peilz (CH); Pablo Espinosa, Pleasanton, CA (US); Peter Kowalczyk, Berkeley, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 378 days.

(21) Appl. No.: 12/727,788

(22) Filed: Mar. 19, 2010

(65) Prior Publication Data

US 2010/0254558 A1 Oct. 7, 2010

Related U.S. Application Data

(60) Provisional application No. 61/162,215, filed on Mar. 20, 2009.

(51) Int. Cl.
*H04R 1/20* (2006.01)

(52) U.S. Cl.
USPC ..... 381/345; 381/384; 181/155; 181/156

(58) Field of Classification Search ..... 181/155, 181/156; 381/345, 387
See application file for complete search history.

(56) References Cited

U.S. PATENT DOCUMENTS

| | | | | |
|---|---|---|---|---|
| 3,696,886 | A * | 10/1972 | Armstrong | 181/156 |
| 3,722,616 | A * | 3/1973 | Beavers | 181/155 |
| 3,739,096 | A | 6/1973 | Iding | |
| 4,054,748 | A | 10/1977 | Balogh | |
| 4,128,738 | A * | 12/1978 | Gallery | 381/335 |
| 4,139,075 | A * | 2/1979 | Kobayashi et al. | 181/148 |
| 4,593,784 | A * | 6/1986 | Flanders | 181/144 |
| 5,115,470 | A | 5/1992 | Sutheim | |
| 5,525,767 | A * | 6/1996 | Fields | 181/155 |
| 5,821,471 | A * | 10/1998 | McCuller | 181/156 |
| 6,258,438 | B1 * | 7/2001 | Loveland et al. | 428/137 |

(Continued)

FOREIGN PATENT DOCUMENTS

| | | | |
|---|---|---|---|
| DE | 102008013627 | A1 | 9/2009 |
| JP | 05049081 | A * | 2/1993 |

OTHER PUBLICATIONS

Studio Magazine, "ME-Geithain Outwits Physics," article, Feb. 2002.
Produktion Partner, "Tamed Bass Energy," article, May 2002.

(Continued)

*Primary Examiner* — Forrest M Phillips
(74) *Attorney, Agent, or Firm* — Beeson Skinner Beverly, LLP

(57) ABSTRACT

A loudspeaker is provided that passively achieves a directional polar response at low frequencies with a high degree of attenuation between the front and the back of the loudspeaker. The loudspeaker 11 has a transducer 13, an enclosure 21 behind the transducer, and port openings 29 in the sidewalls 23 of the enclosure to allow a back-wave produced by the transducer to exit the enclosure and combine with the front wave produced by the transducer. Cancellation behind the loudspeaker at low frequencies is achieved by delaying the back wave with low loss. Low loss delay at low frequencies is achieved by inserting a low-density fibrous fill material 33 in the acoustic chamber 27 formed behind the transducer 13 by the enclosure 21. A fibrous material is selected having a low-pass transfer function and low acoustic loss in its low-frequency pass band.

24 Claims, 9 Drawing Sheets

U.S. PATENT DOCUMENTS

| | | | | |
|---|---|---|---|---|
| 6,665,412 | B1 | 12/2003 | Mizoguchi | |
| 7,236,606 | B2 | 6/2007 | Werner | |
| 7,448,467 | B2 * | 11/2008 | Wright et al. | 181/149 |
| 7,477,755 | B2 * | 1/2009 | Saiki et al. | 381/349 |
| 7,614,479 | B2 * | 11/2009 | Plummer | 181/199 |
| 7,840,022 | B2 * | 11/2010 | Matsumura et al. | 381/345 |
| 2008/0169151 | A1 * | 7/2008 | Barrios et al. | 181/156 |

OTHER PUBLICATIONS

Lothar Cremer, "Lectures on Technical Acoustics," lecture notes, p. 177, 1971.

* cited by examiner

LOUDSPEAKER WITH PASSIVE LOW FREQUENCY DIRECTIONAL CONTROL

CROSS-REFERENCE TO RELATED APPLICATIONS

This application claims the benefit of U.S. Provisional Application No. 61/162,215, filed Mar. 20, 2009, which is incorporated herein by reference.

BACKGROUND OF THE INVENTION

The present invention generally relates to loudspeakers, and more particularly relates to a loudspeaker intended to have a directional polar pattern across its operating frequency range, including at low frequencies.

The term "polar pattern" refers to distribution of acoustic energy throughout space generated by the loudspeaker, and is typically expressed in units of decibels (dB) as the magnitude of sound pressure at points on a circle or sphere around the loudspeaker relative to the sound pressure on axis (at zero degrees, directly in front of the transducer. At high frequencies where wavelengths are small relative to the transducer diaphragm, loudspeakers are naturally directional and often produce directional polar patterns described as "cardioid." (A true cardioid polar pattern would exhibit a maximum sound pressure level on axis in front of the loudspeaker (zero degrees) and no sound pressure on axis behind the loudspeaker (180 degrees). Variations of a true cardioid pattern include "hypercardioid" and "supercardioid.") Furthermore, polar patterns at high frequencies can be easily manipulated with waveguides (horns). However, at low frequencies, where the wavelengths are larger than the transducer diaphragm, loudspeakers tend to generate omni-directional polar patterns. Extending the directional characteristics of a loudspeaker down into low frequency ranges presents a challenge for loudspeaker designers.

One known approach to producing directional characteristics in loudspeakers at low frequencies is to add secondary transducers that are optimized to cancel the acoustic energy created by the primary transducers of the loudspeaker in a desired region in space. Such cancellations result in a directional polar pattern. For example, it is known to employ two low frequency transducers, one of which operates normally, and the other of which is optimized to cancel the acoustic energy produced by the first radiator in the region behind the loudspeaker, thus producing a cardioid or near cardioid polar pattern at low frequencies. This is achieved by driving the second radiator with a polarity-inverted and time-delayed signal that has a different equalization than the first radiator, such that at the desired points in space the contributions of the two radiators are equal in magnitude and opposite in polarity. Similarly, directional polar patterns have been produced from sets of more than one radiator by providing a corresponding set of secondary radiators optimized to selectively cancel acoustic energy produced by the set of primary radiators. While such "active" approaches have proven effective, they require twice the number of radiators and amplifiers, as well as complicated signal processing circuitry. They are therefore relatively costly to manufacture.

Another approach to achieving directional polar patterns over a wide frequency range is described in U.S. Pat. No. 3,739,096. Here, a loudspeaker system is described wherein a speaker enclosure is provided with slits covered by an acoustic damping material that behaves like an acoustic resistor. In this approach, the slits, which effectively create a resonant pipe within the enclosure behind the transducer diaphragm, allow the acoustic pressure wave generated by the back of the transducer diaphragm to propagate out of the enclosure, where it can combine with the acoustic energy in the front-wave which refracts around the loudspeaker enclosure. To produce cancellations in such a passive approach, the back-wave emerging from the loudspeaker enclosure needs to be delayed due to differences in the front and back-wave path lengths at the point of cancellation behind the loudspeaker. It is well known that damping an oscillation introduces a delay. However, damping also reduces the amplitude of the oscillation. Thus, while covering enclosure ports or slits as described in U.S. Pat. No. 3,739,096 may delay the back-wave somewhat, such an approach is not very effective in producing high degrees of attenuation between the front and the back of the loudspeaker's polar pattern, achieving at best a "sub-cardioid" response wherein the cancellation at 180 degrees is incomplete. To achieve high levels of attenuation, and thus a high degree of directionality such as occurs in a true cardioid or hyper cardioid response, the back-wave exiting a ported enclosure not only must be delayed sufficiently to be polarity inverted in the desired region of cancellation, it must have a magnitude that is substantially unattenuated in relation to the magnitude of the front-wave being canceled.

The present invention provides a loudspeaker that overcomes the drawbacks of prior approaches to achieving directional control of the acoustic energy produced by the loudspeaker at low frequencies. The loudspeaker of the invention eliminates the complexity and added costs of active approaches to producing desired cancellations behind the loudspeaker, and provides a unique and effective approach of producing highly directional polar patterns with high front-to-rear attenuations of the acoustic energy produced by the loudspeaker.

SUMMARY OF THE INVENTION

Briefly, the present invention provides a loudspeaker that passively achieves a directional polar response of the loudspeaker at low frequencies with a high degree of attenuation between the front and the back of the loudspeaker. It is contemplated that attenuations on the order of minus 10 dB at 180 degrees can be achieved in a loudspeaker made in accordance with the invention having a single transducer. However, the invention is not limited to loudspeakers having a single transducer. It is contemplated that loudspeakers in accordance with the invention can include additional low frequency transducers, and that the invention can be incorporated into a loudspeaker system having high frequency transducers, for example, a horn loaded high-frequency driver.

In accordance with the invention, the high degree of front-to-back attenuation is achieved by providing the loudspeaker with a ported enclosure and filling at least a portion of the interior chamber of the enclosure with a low density fibrous acoustic fill material placed behind the loudspeaker's transducer so that it extends substantially over and preferably entirely over the enclosure's port openings. The acoustic fill material must be chosen to have particular acoustic properties, namely: it must have a low-pass characteristic, and it must have low-loss characteristics in the desired low frequency range. The port openings are preferably covered by a low-loss, acoustically transparent screen or screens. Such screens will advantageously contribute to the suppression of the resonance of the enclosure at the enclosure's resonant frequency. The grill screens can suitably be fabricated from a sheet aluminum material having an adhesive backing (except over the port areas) that allows the screens to be attached to the surface of the enclosure sidewalls 23.

Selecting a fill material for use in the enclosure requires selecting and experimenting with different fibrous materials to determine if they have the peculiar acoustic properties necessary to delay the back-wave exiting the port openings of the loudspeaker's enclosure at low frequencies without attenuation. It has been discovered that a certain mineral wool exhibits the necessary properties for the fill material.

Various aspects of the invention will be apparent to persons skilled in the art from the description of the illustrated embodiment.

DESCRIPTION OF THE ILLUSTRATED EMBODIMENT

Figure 1A:
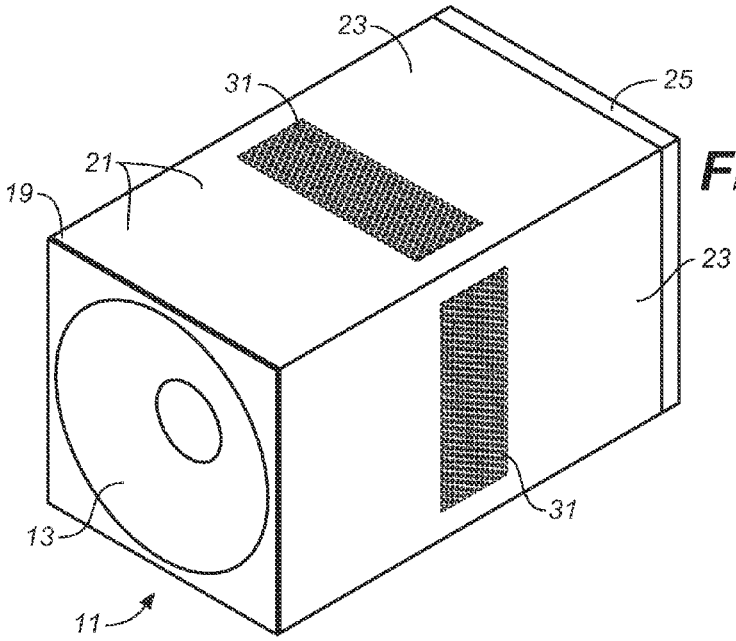
FIG. 1A is a graphical perspective view of a loudspeaker in accordance with the invention, wherein a single transducer is mounted to a ported enclosure.

Referring now to the drawings, FIGS. 1A, 1B, 2, 3A, and 3B graphically illustrate a loudspeaker in accordance with the invention, wherein the loudspeaker 11 is shown as including a single transducer 13 in the form of a cone radiator having a diaphragm 15 and magnetic base assembly 17. The transducer, which produces acoustic energy from an electrical audio signal source, is mounted to the front end 19 of an enclosure 21 having sidewalls 23 and a back wall 25. The cone driver can be mounted to the front end of the enclosure by mounting it directly to the ends of the enclosure sidewalls, or could be mounted to a front baffle wall of the enclosure. With a relatively small loudspeaker, the enclosure 21 can advantageously be fabricated from a single piece of machined extruded aluminum. In the illustrated embodiment, the enclosure has a square shape about its longitudinal axis. As a result, the enclosure sidewalls 23 have the same width.

The enclosure provides an internal acoustic chamber 27 behind the transducer 13, which contains a volume of air. The transducer 13 must be constructed with an open frame that exposes the back of its diaphragm 15 to this internal acoustic chamber. This will allow the back-wave produced by the diaphragm of the transducer to propagate into the chamber. It is noted that other components of the loudspeaker system may reside within internal chamber 27, such as an electronic module 28 described in further detail below.

Figure 6:
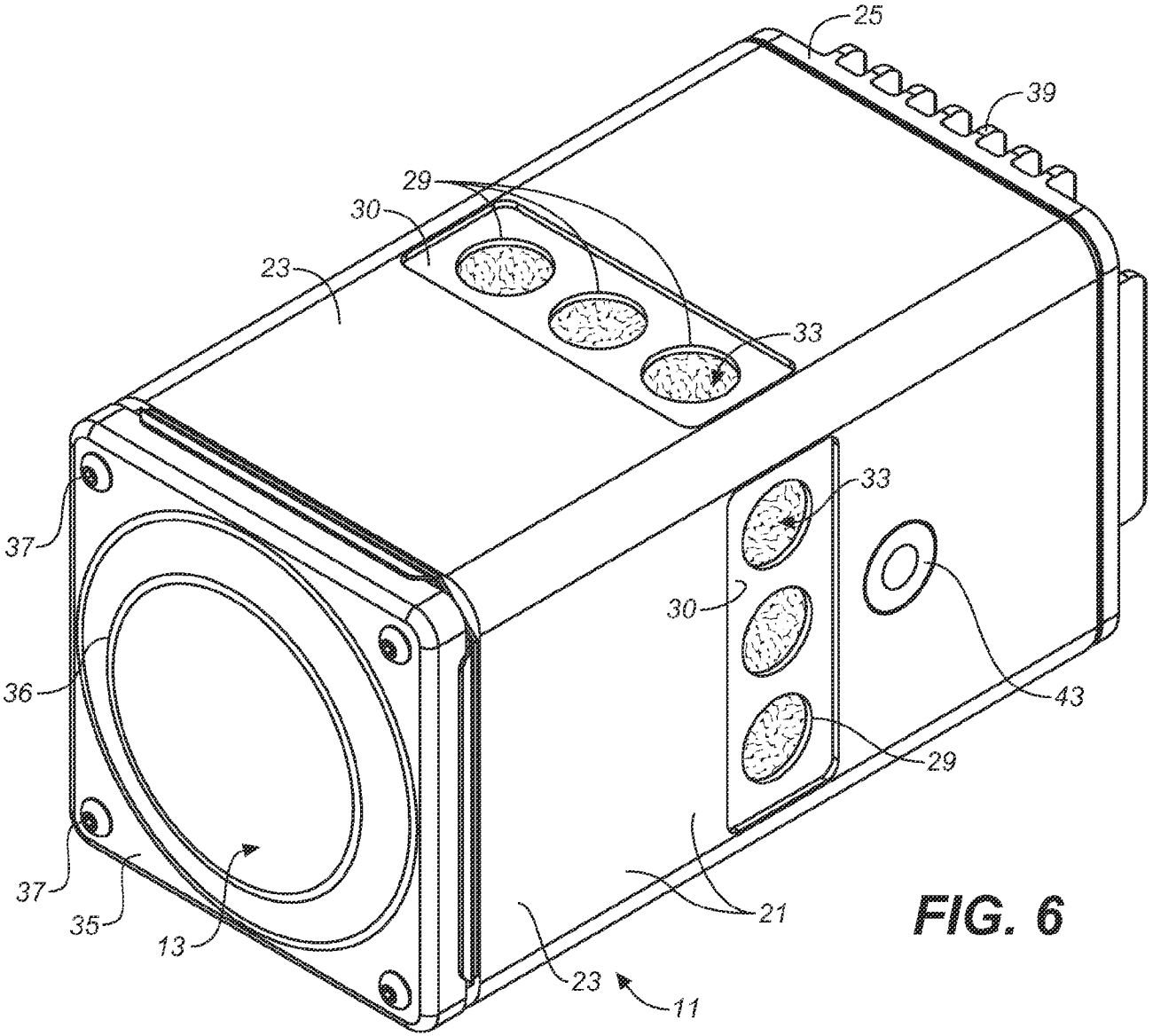
FIG. 6 is another perspective view thereof showing the loudspeaker with the screens over the port openings or the ported enclosure removed.

The enclosure 21 is substantially sealed, except for port openings 29. The port openings are located in the enclosure's sidewalls 23, and are preferably displaced behind the transducer by a distance approximately equal to the diameter of the transducer's cone diaphragm. Port openings are preferably provided on each side of the enclosure. Where more than one port opening is provided per side, as illustrated in FIGS. 1A and 6, there will preferably be an equal number of port openings per side. In either case, the port openings are preferably configured to provide a symmetrical distribution of ports around the enclosure.

As seen in FIG. 1, the ports on each side of the enclosure are preferably covered by grill screens 31, which can be meshes or gratings. The primary function of the grill screens is to protect the interior of the enclosure from entry of unwanted objects. However, because they will also function as acoustic resistors, they can also help to damp the resonance of the enclosure. The grill screens preferably are designed to introduce a minimum amount of loss as the acoustic energy passes through the screens. The total open area presented by the ports through the screen perforations, and hence the size of the port openings, is an important factor in achieving the cardioid polar response with a high degree of attenuation between the front and the back of the loudspeaker. As further discussed below, the size of the port openings for achieving an acceptable polar response is determined empirically.

The loudspeaker system of the invention achieves significant attenuation of the acoustic energy directed behind the loudspeaker by more effectively using the back-wave to cancel the front-wave in a region in space behind the loudspeaker. To achieve these desired cancellations, a time delay is necessary to compensate for the difference in travel time between the front-wave, which diffracts around the enclosure, and back-wave, which exits the port openings 29. Because the back-wave travels a shorter, more direct path to the region behind the loudspeaker, it must be delayed without significant attenuation in order to maintain equal magnitude and opposite polarity from the front-wave at the desired point of cancellation.

Figure 3A:
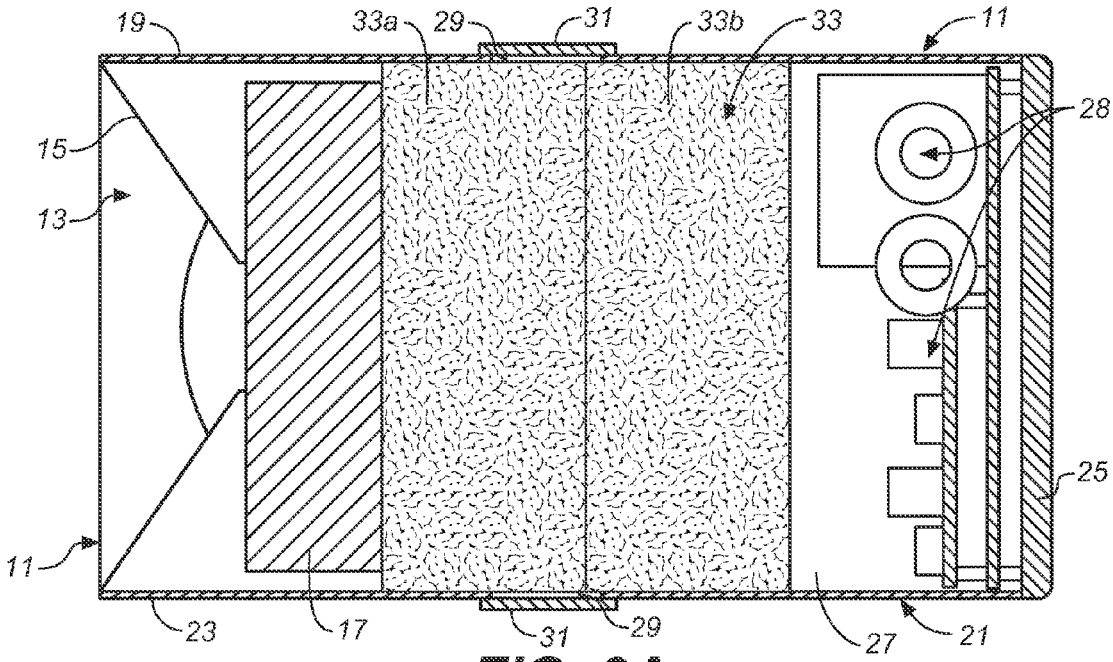
FIG. 3A is a sectional view thereof taken along lines 3-3 in FIG. 2, showing the low density fibrous acoustic fill material behind the loudspeaker's transducer provided in two layers.
Figure 3B:
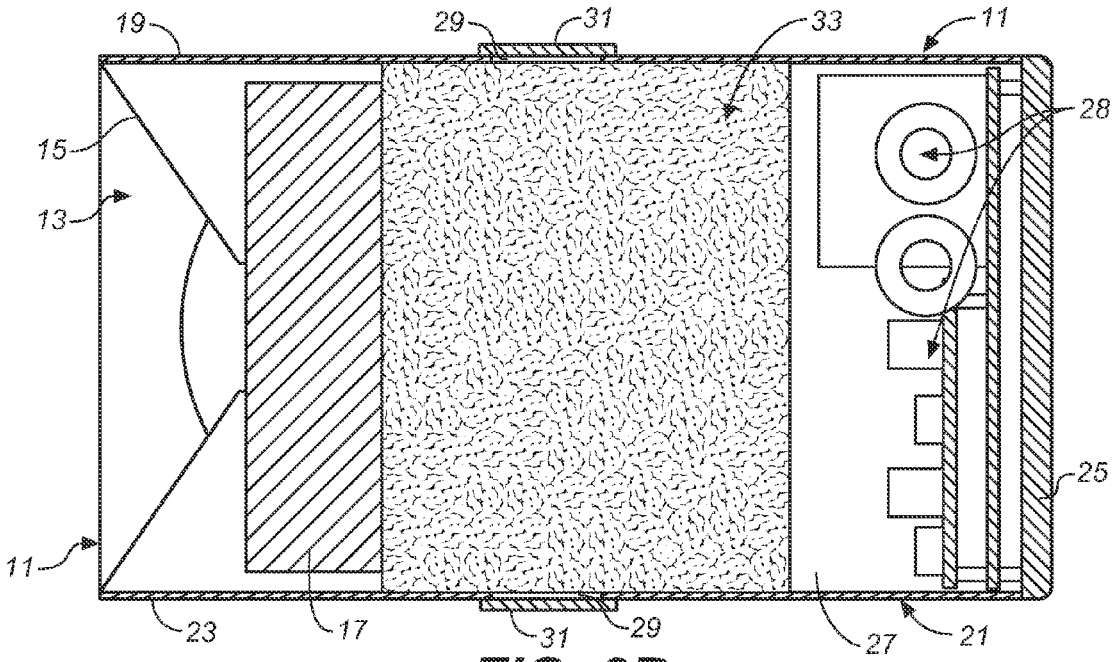
FIG. 3B is a sectional view thereof taken along lines 3-3 in FIG. 2, showing the low density fibrous acoustic fill material behind the loudspeaker's transducer provided in a single layer.

In accordance with the invention, a low loss delay, required to achieve high front-to-back attenuation in the loudspeaker's polar pattern at low frequencies, is uniquely achieved by inserting a low-density fibrous acoustic fill material, denoted by the numeral 33 in FIGS. 3A and 3B, in the loudspeaker's acoustic chamber 27 behind the transducer 13. It is discovered that a properly chosen low-density fibrous fill material can effectively produce the required delay in the back-wave without loss. To produce lossless delay at low frequencies, the fill material must have a low-pass transfer function and low acoustic loss in its low-frequency pass band. The acoustic fill material is preferably chosen that exhibits the following characteristics:

- the maximum low-frequency attenuation through the material does not exceed −2 dB, and
- the material exhibits a transfer function which approximates a first order low pass filter with a corner frequency of approximately 700 Hz, with attenuated magnitude and negative phase shift (delay) with increasing frequency.

The acoustic fill material preferably fills a substantial portion of the interior acoustic chamber 27 of enclosure 21, and preferably fills the entirety of the chamber between the back of the transducer 13 and a location that allows the fill material to at least substantially cover, and preferably entirely cover, the port openings 29. Avoidance of air gaps between the fill material and the enclosure sidewalls is considered important to the effectiveness of the fill material, as air gaps are likely to allow some acoustic energy to by-pass the fill material and compromise the resulting cancellations.

It has been found that providing a three inch thick block of Roxul AFB Mineral Wool in a four inch square enclosure behind a transducer having a diameter of 3.25 inches, fulfills the above requirements. As shown in FIG. 3A, the three inch thick block of mineral wool can be created by two 1.5 inch back-to-back layers denoted 33*a* and 33*b*. It might also be created by a higher number of thinner layers. However, it is found that a single layer produces the most consistent results in terms of the desired polar response. By using a single layer, interfaces between layers that might produce reflections at certain frequencies are eliminated.

It should be noted that not all low density fibrous materials will have the necessary characteristics for achieving the objects of the invention. As discussed in more detail below, determination of whether a particular low density fibrous material will meet the necessary low-pass, low-loss requirements can be determined empirically by an evaluation of the acoustic transfer function of the proposed material.

Figure 4:
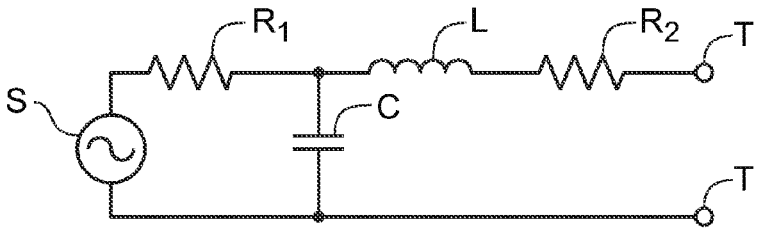
FIG. 4 is a circuit diagram showing a simplified and rough circuit equivalent of the loudspeaker components shown in FIG. 3.
Figure 5:
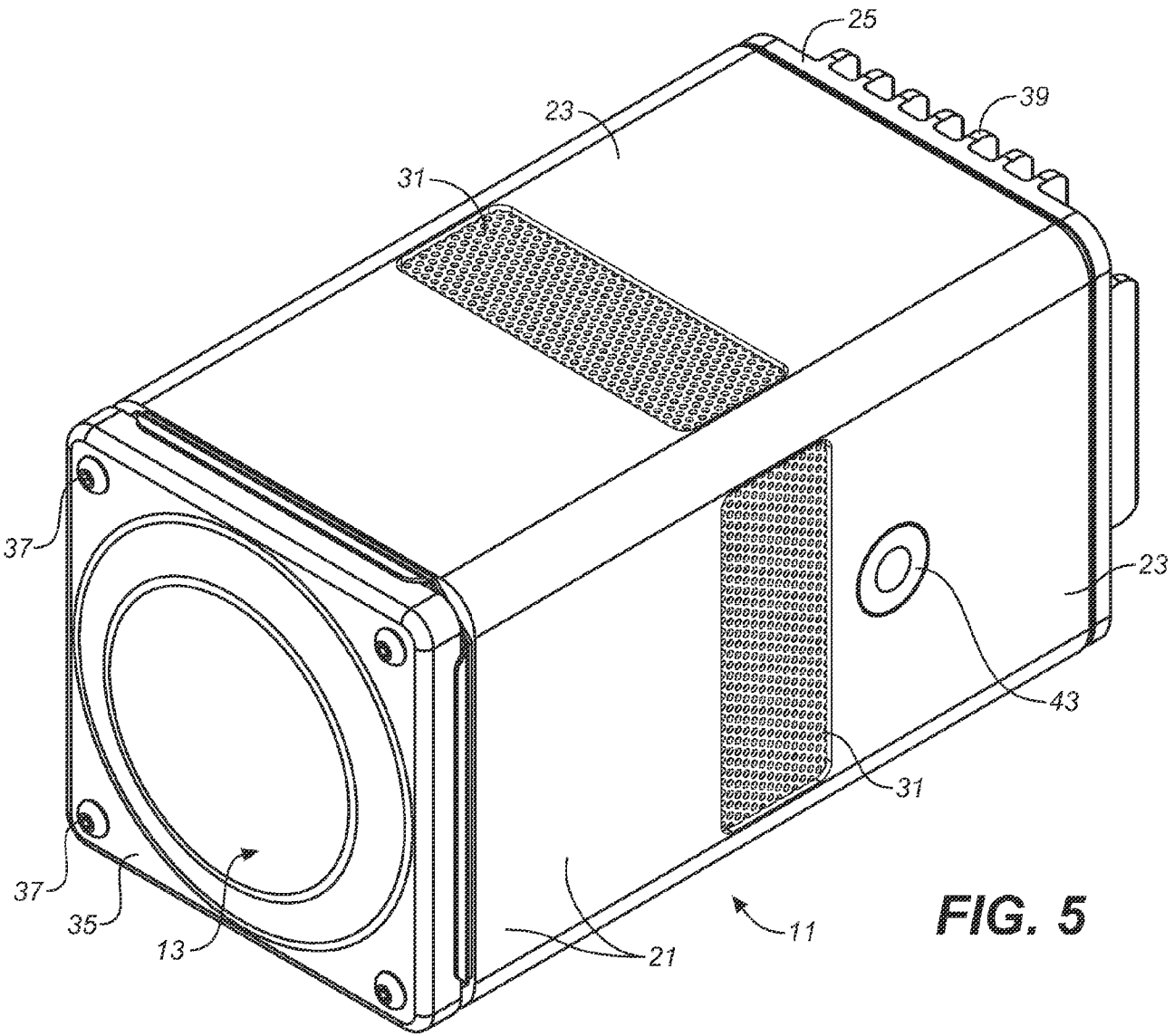
FIG. 5 is a perspective view of an exemplary embodiment of the loudspeaker graphically illustrated in FIGS. 1-3.

The low pass circuit equivalent of the illustrated and above-described loudspeaker is shown in FIG. 4, wherein the transducer 13 is represented as a signal source S, the enclosure 21 is represented by a parallel capacitor C, the low-density fibrous acoustic fill material 33 having the above-described characteristics is represented as the series resistor $R_1$, the enclosure ports 29 are represented as a series inductor L, and the screen 31 over the port openings is represented as a series resistor $R_2$. Like an electrical low pass filter as shown in FIG. 4, which delays the signal from signal source S as it passes to the filter's output terminals T, the physical low pass filter provided by the above-indicated components of the loudspeaker 11 delays the low frequency acoustic pressure waves passing through the fibrous fill material and port openings without attenuating the back-wave. With the necessary delay accomplished by a suitable low density fibrous fill material, the delay introduced by the screens 31, which cover the port openings 29, should be minimized to prevent excessive delay. The screens are preferably acoustically transparent, with no acoustic loss being introduced by the screens.

It is further noted that the low-pass filter characteristics of the acoustic fill material 33 means that high-frequency energy is filtered out of the back-wave. However, because the loudspeaker becomes directional at high frequencies, cancellation of acoustic energy behind the loudspeaker at high frequencies is unnecessary. Indeed, this characteristic of the fill material provides a number of advantages. First, the substantial elimination of high-frequency energy in the back-wave will substantially eliminate the detrimental effect such energy would have on the overall polar pattern. Second, the acoustic fill material also serves to substantially damp the resonance of the enclosure. Without this damping effect, the back-wave would excite the enclosure resonance, resulting in excess acoustic energy at that resonant frequency. This excess energy would overwhelm the front-wave and prevent rear cancellations at the resonant frequency. Finally, the acoustic fill material can be used to reduce the cross-sectional area of the enclosure to approximately the same area as the diaphragm of the transducer. By keeping the area roughly the same as that of the transducer diaphragm, it has been found that attenuation of the back-wave as it exits the enclosure can be kept to less than one dB.

Figure 7:
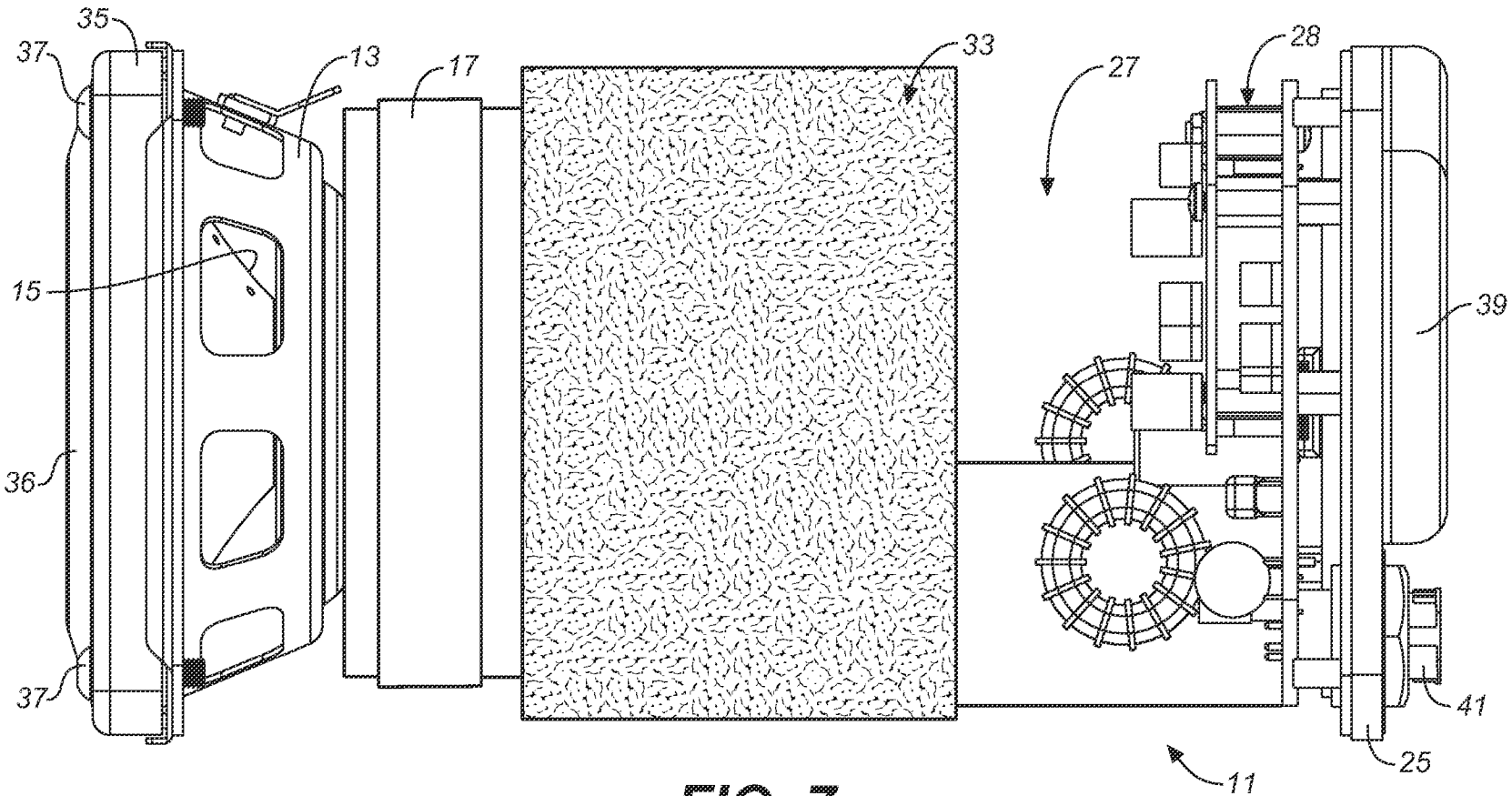
FIG. 7 is a side elevational view thereof with the sidewalls of the enclosure removed for illustrative purposes.
Figure 9:
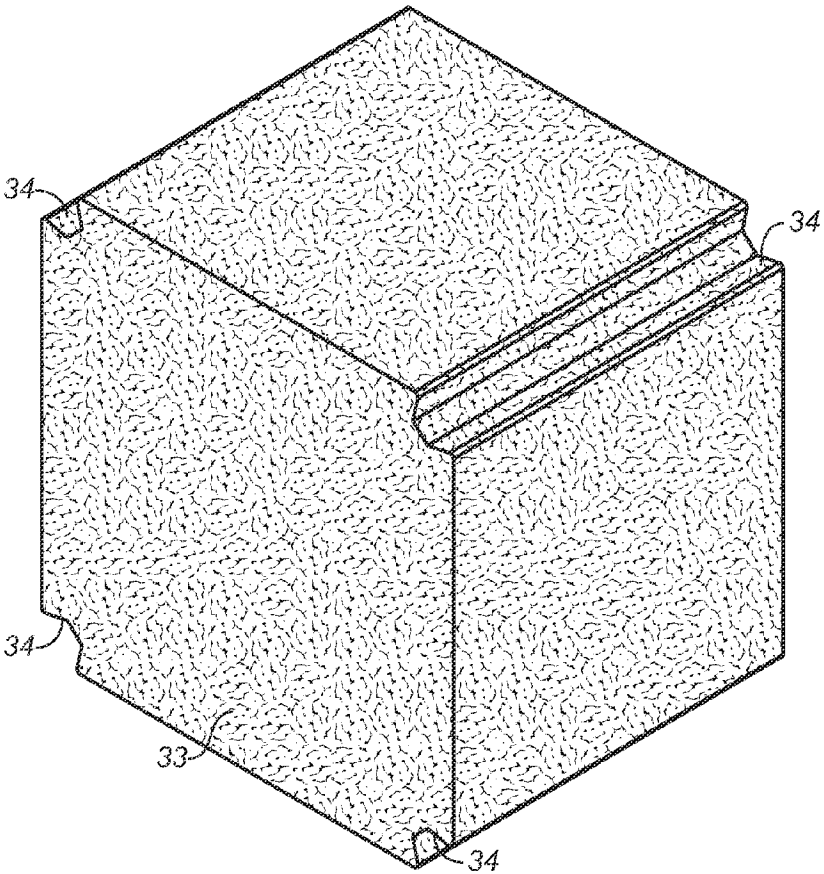
FIG. 9 a top perspective view of a block of the low density fibrous acoustic fill material used in the loudspeaker enclosure.
Figure 8:
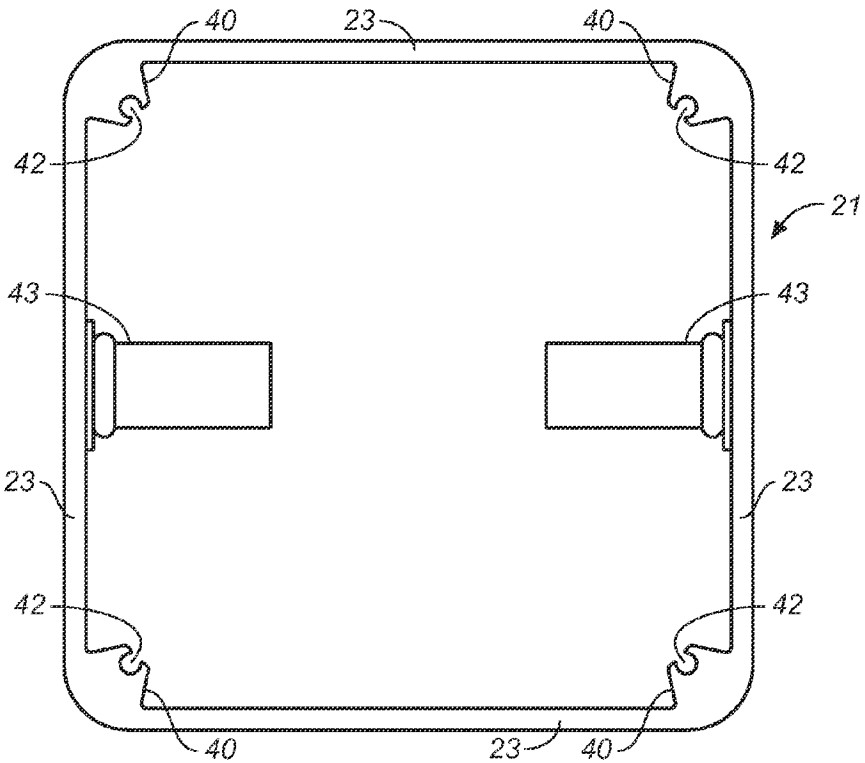
FIG. 8 is an end elevational view of the enclosure of the loudspeaker without the backwall or transducer mounting frame attachments.

FIGS. 5-9 show a physical implementation of the loudspeaker system graphically depicted in FIGS. 1, 2, 3A, and 3B, wherein the transducer 13 has a square mounting frame 35 fastened to the front end 19 of enclosure 21 by means of corner screws 37, which screw into screw channels 42 in corner bosses 40 formed at the interior corners of the enclosure sidewalls 23 shown in FIG. 8. FIG. 9 shows a die cut block of an acoustically appropriate low density fibrous fill material 33, such as a 3 inch thick block of Roxul AFB Mineral Wool. It is noted that the perimeter block 33 conforms to the internal cross-sectional shape of the loudspeaker enclosure 21, including the provision of corner cut-notches 34 that fit over the internal corner bosses 40 of the enclosure. The fill material block is inserted into the enclosure 21 before the transducer and transducer mounting frame are secured to the front end of the enclosure, and will preferably fill the enclosure from the back of the transducer magnetic assembly 17 to a location behind the port openings 29.

As best seen in FIG. 7, the back wall 25 of the enclosure supports the internal electronic module 28, as well as external heat radiation fins 39 and electrical connectors 41. The port openings 29 are preferably distributed around the enclosure's sidewalls 23 at a distance behind the radiator's diaphragm approximately equal to the diameter of the transducer. Screens 31 are seen to be inset into elongated recessed areas 30 in the sidewalls which surround the port openings. Each of the grill screens can suitably be fabricated from sheet aluminum in the form of screen plates having a shape conforming to the recessed areas 30. An adhesive backing can be provided on the back of the screen plates (except in the area of the port openings) to allow the screens to be secured in the enclosure recesses.

Figure 1B:
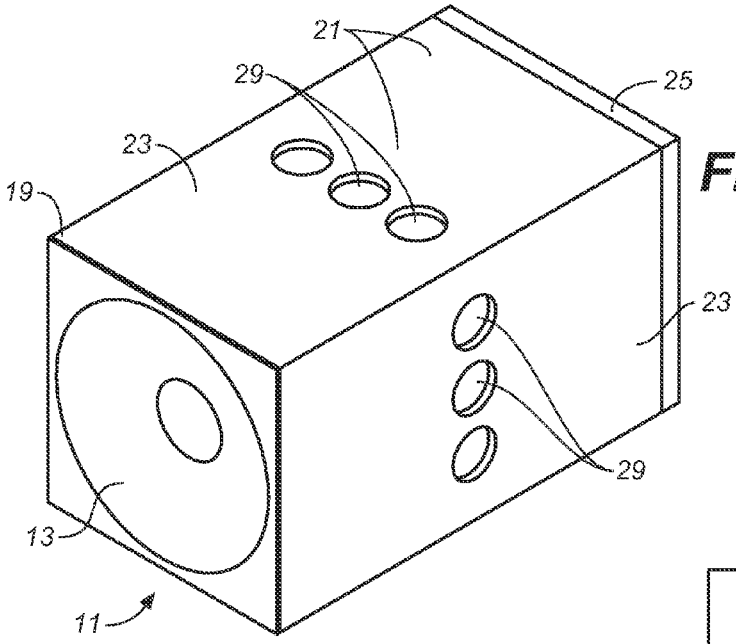
FIG. 1B is another graphical perspective view thereof showing the loudspeaker with the screens over the port openings or the ported enclosure removed.
Figure 2:
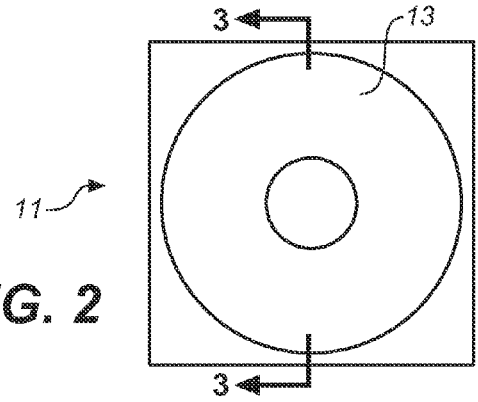
FIG. 2 is a front elevational view thereof.

The total open area of the port openings 29 as restricted by the perforated screens 31 has a substantial effect on the polar response of the loudspeaker. Thus, the sizing of the ports is important to achieving acceptable cardioid performance. A port opening design that achieves an acceptable cardioid polar response can be determined empirically by trial-and-error. For example, in the case of a loudspeaker having three circular port openings, as shown in FIGS. 1B and 6, a four inch by four inch wide enclosure 21 filled with two 1½ inch thick layers of Roxul AFB Mineral Wool, and a transducer having a transducer diaphragm diameter of 3.25 inches, it has been found that the following attributes of the port openings and screen produce an acceptable cardioid polar response at low frequencies:

- the total area of the ports per side is 1.325 square inches, for a total of 5.3 square inches for all four sides;
- screen plates are fabricated of aluminum sheet material having a thickness of 0.05 inches and a perforation open area of roughly 19%, resulting in a total open area through the perforations for all four sides of the loudspeaker enclosure of approximately 1.007 square inches.

As further indicated below, it is understood that different screen materials and port opening sizes and configurations could be used, provided they do not unacceptably degrade the desired polar pattern and low frequency response of the loudspeaker.

As earlier noted, the invention contemplates the possibility of using more than one transducer. When multiple transducers of different sizes are used, it is contemplated that the largest transducer will dictate the space between the transducers and the enclosure ports. In such cases, it is also contemplated that the total combined open area of the ports will be dictated by the surface area of the radiating portion of the largest transducer. As in the illustrated embodiments, the size of the ports required to achieve an acceptable polar response can be determined empirically.

The loudspeaker enclosure 21 shown in FIGS. 5-8 is also seen to include suitable mounted hardware, such as the illustrated post connector 43 (which projects into the enclosure as shown in FIG. 8), and an acoustically transparent front grill 36 for covering the diaphragm of the transducer 13. The block of fibrous material 33 would suitably extend from the back of the transducer to the internally projecting post connectors.

The electronic module 28 at the back of the enclosure's internal chamber 27 is suitably an integrated electronics package containing an amplifier and signal processing circuitry. The electronics package preferably accepts a balanced audio signal through connector 41 from an audio mixer or other source, which can be modified and processed as follows:

- Frequencies outside the intended operating range of the loudspeaker (e.g. radio frequencies or a DC offset) are filtered out.
- The composite frequency response is shaped to compensate for the response variations of the driver and enclosure, resulting in a generally flat overall response within the intended operating range.
- The peak amplitude of the signal is limited with a fast time constant to minimize amplifier clipping, which results in increased harmonic distortion.
- The RMS voltage of the signal is limited with a slow time constant to protect the transducer from damage due to overheating.
- The signal is amplified by a power amplifier stage capable of driving the relatively low impedance transducer.

When the invention is embodied as a miniature loudspeaker system where efficiency is essential to producing suitable sound pressure levels, the amplifier stage may advantageously be implemented using Class-D (pulse width modulation) amplifier technology.

Figure 10:
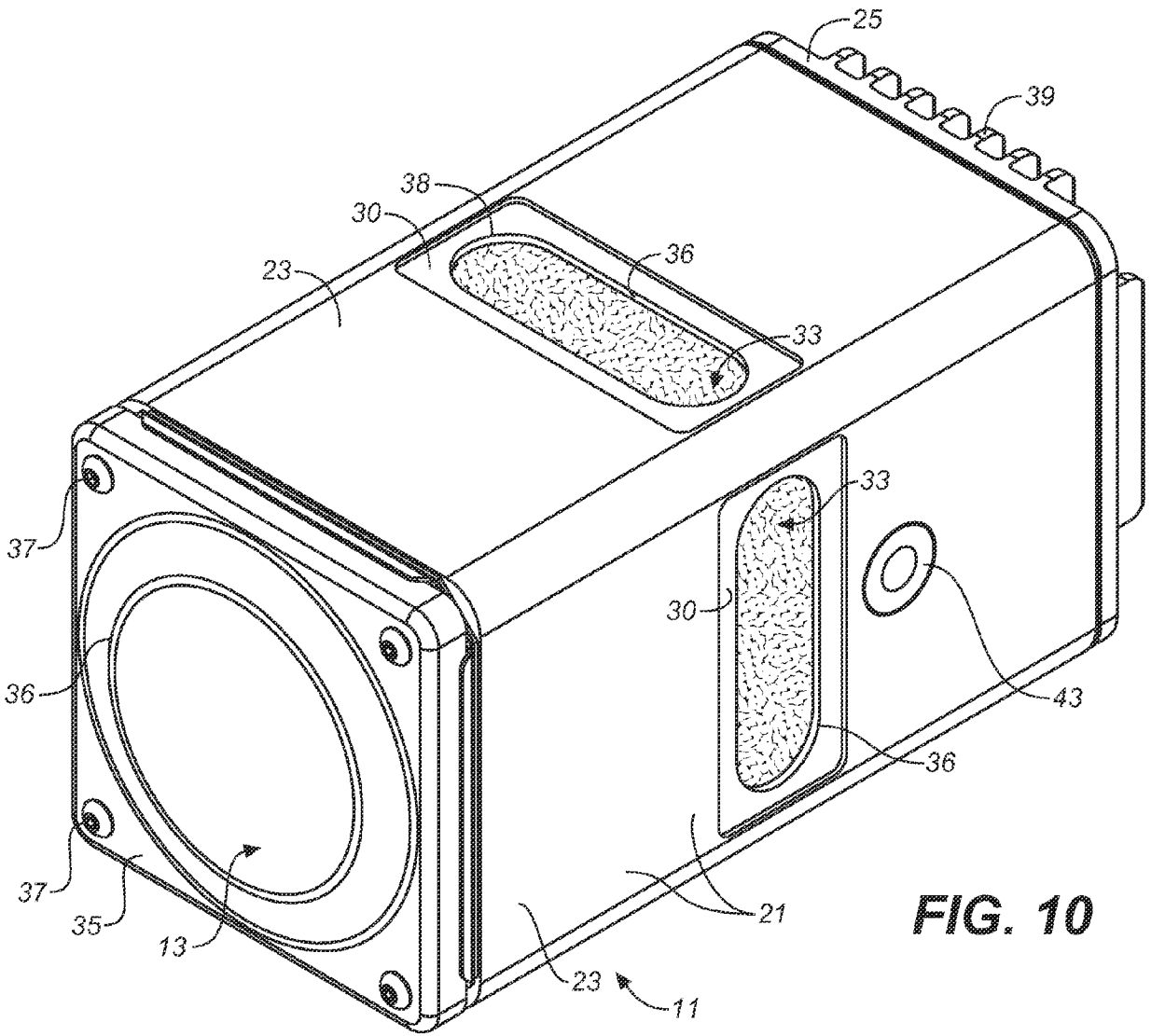
FIG. 10 is an exploded perspective view of another exemplary embodiment of a loudspeaker in accordance with the invention having a different configuration for the port openings in the loudspeaker enclosure.

FIG. 10 shows an alternative to the embodiment of the loudspeaker system above-described, wherein, instead of having multiple openings, each of the sidewalls 23 of enclosure 21 has a single elongated port opening 36 that preferably has rounded ends 38 to form an elongated race track-shaped port. (The rounded ends prevent undesirable refractions that can occur around square corner surfaces.) This port opening configuration increases the total area of the port openings as compared to the previously described embodiments and has been found to improve the low frequency cardioid polar pattern of the loudspeaker.

For example, in the case of a loudspeaker having the race track-shaped port openings as shown in FIG. 10, a four inch by four inch wide enclosure 21 filled with a 3 inch block of Roxul AFB Mineral Wool, and a transducer having a transducer diaphragm diameter of 3.25 inches, it has been found that the following attributes of the port openings and screen plates produce an improved cardioid polar response at low frequencies as compared to the three port per side port configuration shown in FIGS. 1 and 6:

- the total area of each port per side is 2.44 square inches for a total of 9.76 square inches for all four sides of the enclosure;
- screen plates 31 are fabricated of aluminum sheet material having a thickness of 0.05 inches and a perforation open area of roughly 19%, resulting in a total open area through the perforations for all four sides of the loudspeaker enclosure of approximately 1.85 square inches.

Like the earlier-described embodiments, the race track-shaped port openings 36 shown in FIG. 10 are distributed around the loudspeaker's enclosure sidewalls 23 preferably at a distance behind the transducer's diaphragm that approximately equals the diameter of the diaphragm. Screens 31 (not shown in FIG. 10) are inset into elongated recessed areas 30 in the sidewalls to cover the port openings, and serve the functions above-described.

Fill Material Evaluation

Figure 11:
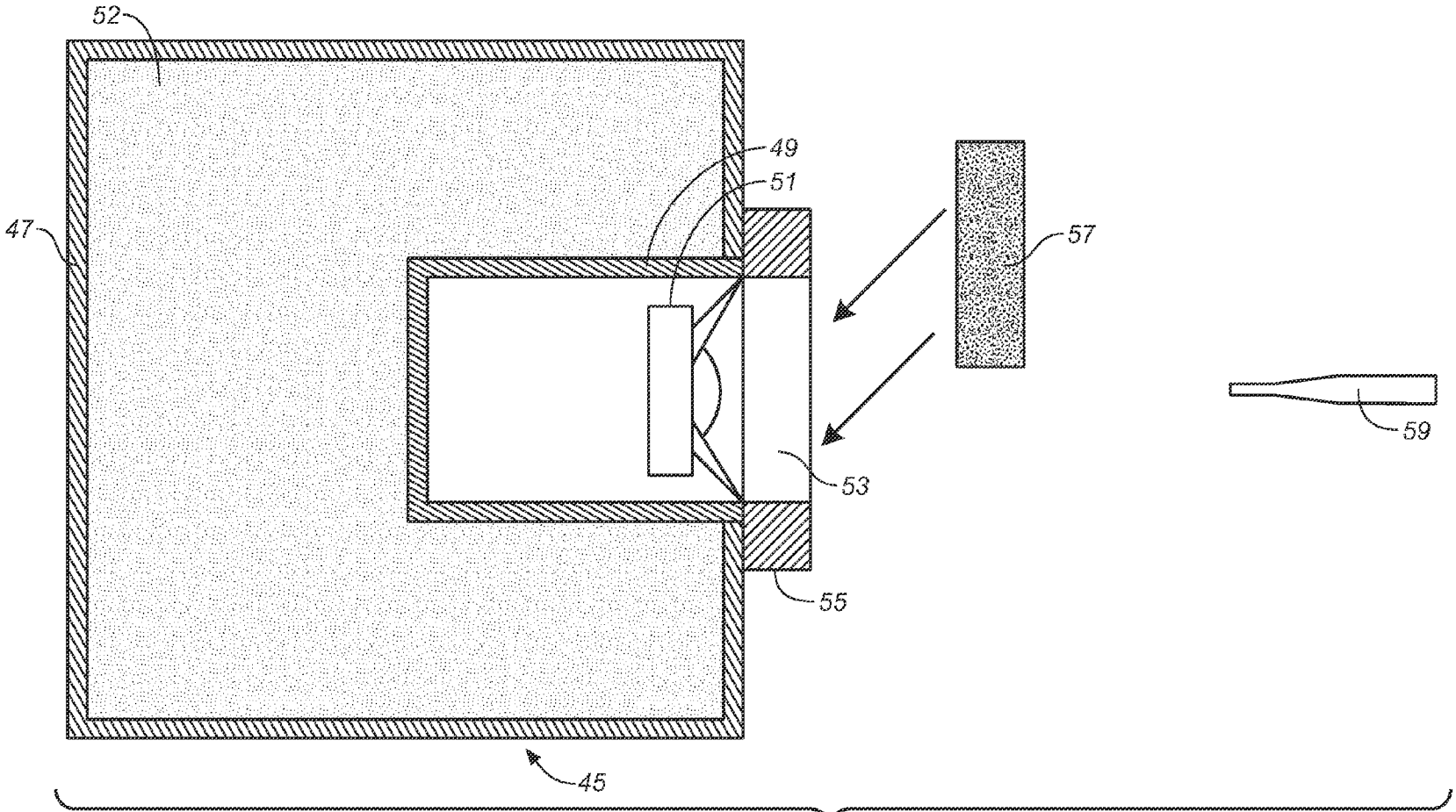
FIG. 11 is a diagrammatic view of an exemplary test box for evaluating acoustic fill materials for the ported enclosure illustrated in FIGS. 3 and 7.

To determine whether a particular fibrous material meets the requirements for the loudspeaker's fill material 33 (exhibiting a low-pass filtering characteristic with low loss in the pass band) the acoustic transfer function of the candidate material must be determined. Referring to FIG. 11, the measurements required to determine a material's transfer function can be made using a test box 45 having an outer enclosure 47, an inner sealed enclosure 49, and a transducer 51 mounted to the front of the inner enclosure. The inner sealed enclosure and radiator can suitably be an existing loudspeaker held within the outer enclosure. To provide acoustic insulation around the loudspeaker, the outer enclosure can be filled with a suitable insulating foam material 52.

The test box is seen to have a front opening 53 through which sound waves produced by the transducer 51 can propagate. This opening is provided by a sample material holding structure 55 on the front of the outer enclosure, which physically holds the sample material to be measured (denoted by the numeral 57) in front of the transducer 51. The opening in the sample holding structure is shaped to firmly hold the material samples without gaps between the holding structure and the material samples. For example, the holding structure can suitably be a square ring having a square opening for holding a square piece of material. The opening is preferably similar in size or slightly larger than the diaphragm of the transducer, and preferably has a depth that allows the material sample to fit entirely within the holding ring. By surrounding the entire sample, the holding ring will prevent acoustic energy produced by the transducer from propagating out of the sides of the sample, and thus from compromising the measurement.

To evaluate a material sample using the test box 45, the transfer function of the test box without a material sample must first be measured. The material sample 57 is then placed in the opening 53 of the test box's sample holding structure 55, and the combined transfer function of the test box with the sample measured. The transfer function measurements can be made using a microphone 59 placed on axis one meter in front of the test box. Microphone 59 is connected to a sound analyzer, such as the commercially available SIM 3 sound analyzer manufactured by Meyer Sound Laboratories, Incorporated, which determines the transfer functions.

Using the measured transfer functions, the transfer function of the material sample can be determined. If the transfer function of the test box without the sample material is denoted H(s), and the transfer function of the test box with the sample material is denoted G(s), then $$G(s)=H(s)*M(s) \quad (1)$$

where M(s) is the transfer function of the material sample. To determine M(s), the second measurement is normalized to the first measurement:

$$M(s)=G(s)/H(s) \quad (2)$$

When G(s) and H(s) are complex frequency response vectors, this process is numerically accomplished by dividing the two vectors as shown in equation (2). The transfer functions $M(s)_n$ of a collection of n materials candidates can now be analyzed to identify which candidates are likely to perform well in a passive cardioid loudspeaker.

Fill Material Caging

As previously described, selected fibrous fill material can be cut into a block of material 33 that fits within the loudspeaker enclosure 21 with no substantial gaps between fill material and the sidewalls 23 of the enclosure. It has been discovered that the front-to-back attenuation in the polar response can be improved somewhat by compressing the fill material in the longitudinal direction without obstructing the acoustic path through the material.

Figure 13:
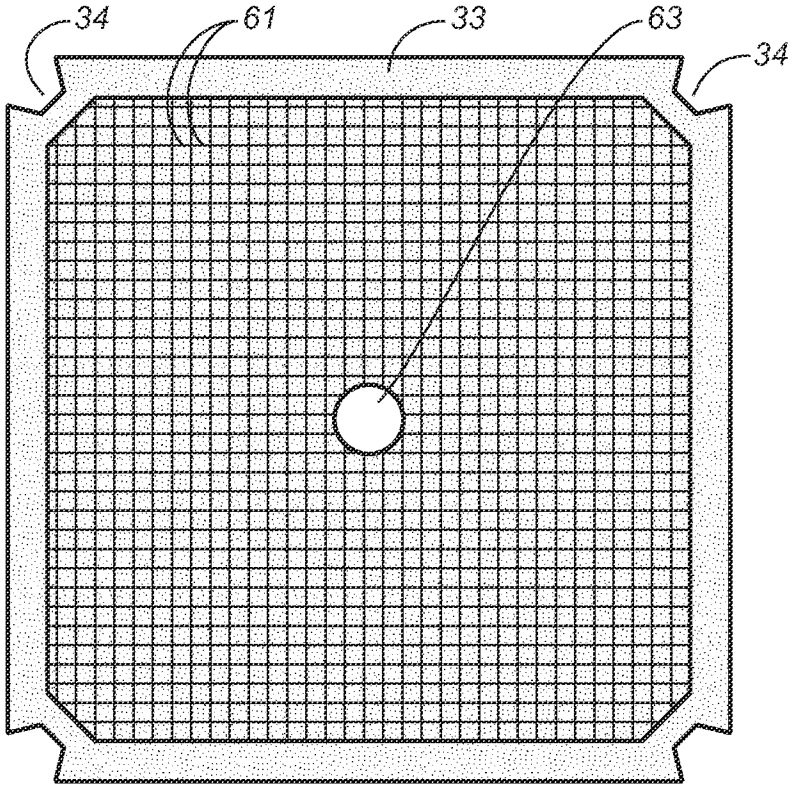
FIG. 13 is a front elevational view thereof.
Figure 12:
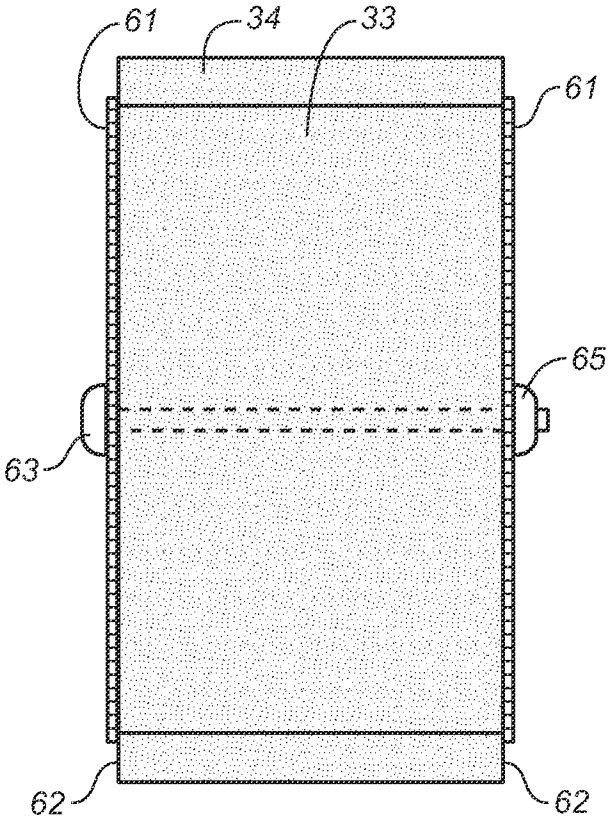
FIG. 12 is a side elevational view of the block of the low density fibrous acoustic fill material seen in FIG. 9 showing a means for advantageously caging the fill material in the longitudinal direction.

Means for compressing the fill material in the longitudinal direction are shown in FIGS. 12 and 13. In these figures, the block of fill material 33 having corner notches 34 is caged in the longitudinal direction by opposed caging screens 61—suitably metal screens—which are held against opposite surfaces 62 of the fill material block by a bolt 63. The bolt preferably extends though the center of the material and can suitably be secured by nut 65, which can be tightened to achieve a suitable degree of compression of the fill material. The degree of compression needed to achieve optimal improvements in the front-to-back attenuation in the loudspeaker's polar response can be determined empirically.

The screens 61 preferably cover most of the surfaces 62 of the fibrous material block 33 to provide uniform compression across the block of material. They also preferably present minimal resistance to the acoustic pressure waves that must pass through them, a characteristic which may be obtained by ensuring a large percentage open area. It is believed that screens having a percentage open area of at least about 40% to 50% would be required to achieve suitable results, however, lower percentages may be possible. Suitable screens can be selected empirically by testing different commercially available screen materials.

While the present invention has been described in considerable detail in the forgoing specification and accompanying drawings, it will be understood that it is not intended that the invention be limited to such detail unless expressly indicated. Other embodiments of the invention not expressly disclosed herein would be readily apparent to persons skilled in the art from this disclosure.

What we claim is:

1. A loudspeaker with passive directional control at low frequencies comprising an enclosure having a front, a back and sidewalls, a transducer mounted to the front of said enclosure, said transducer having a diaphragm for producing acoustic energy from an electrical audio signal, said acoustic energy being produced as front-waves and back-waves, an acoustic chamber in said enclosure behind said transducer for receiving back-waves produced by said transducer, at least one port opening in said enclosure through which acoustic energy in said acoustic chamber produced by said transducer can exit said enclosure, and an acoustic fill material that substantially fills the entirety of the internal acoustic chamber of said enclosure between the sidewalls thereof and that extends from about said transducer for a distance that substantially covers said at least one port opening, said acoustic fill material having a low pass, low loss transfer function, wherein back-waves introduced into said acoustic chamber by said transducer experience delay at low frequencies with minimal attenuation before they exit said enclosure through said at least one port opening.

2. The loudspeaker of claim 1 wherein port openings are provided in at least one sidewall of said enclosure.

3. The loudspeaker of claim 1 wherein at least one port opening is provided in each sidewall of said enclosure.

4. The loudspeaker of claim 1 wherein a single port opening is provided in each sidewall of said enclosure.

5. The loudspeaker of claim 4 wherein said port opening has an elongated oval shape.

6. The loudspeaker of claim 1 wherein the loudspeaker has a polar response characteristic, and wherein the total area of said port opening is empirically selected to achieve a high degree of attenuation in the polar response at the back of the loudspeaker.

7. The loudspeaker of claim 1 wherein said acoustic fill material is a low density fibrous material having a low pass, low loss transfer function.

8. The loudspeaker of claim 7 wherein said low density fibrous material is a mineral wool having a low pass, low loss transfer function.

9. The loudspeaker of claim 1 wherein said acoustic fill material extends from said transducer to at least substantially cover the at least one port opening in said enclosure.

10. The loudspeaker of claim 1 wherein said acoustic fill material has a maximum low-frequency attenuation through the material of no greater than approximately −2 dB.

11. The loudspeaker of claim 1 wherein the transfer function of the fill material approximates a first order low pass filter having a corner frequency of approximately 700 Hz.

12. The loudspeaker of claim 1 wherein the transfer function of the fill material exhibits attenuated magnitude and negative phase shift with increasing frequency.

13. The loudspeaker of claim 1 wherein said at least one port opening is covered by a substantially acoustically transparent screen element.

14. The loudspeaker of claim 1 wherein said acoustic fill material is caged in the longitudinal direction in said enclosure to compress the acoustic fill material in said longitudinal direction.

15. The loudspeaker of claim 1 wherein said acoustic fill material is provided in a single block of acoustic fill material.

16. The loudspeaker of claim 1 wherein the at least one port opening is covered by a grill screen that provides an acoustic resistance at the port opening.

17. A loudspeaker with passive directional control at low frequencies comprising an enclosure having a front, a back and sidewalls, a transducer mounted to the front of said enclosure, said transducer having a diaphragm for producing acoustic energy from an electrical audio signal, said acoustic energy being produced as front-waves and back-waves, an acoustic chamber in said enclosure behind said transducer for receiving back-waves produced by said transducer, at least one port opening in each of the sidewalls of said enclosure through which acoustic energy in said acoustic chamber produced by said transducer can exit said enclosure, a grill screen covering each of said port openings, said grill screens providing a low loss acoustic resistance at each port opening, and an acoustic fill material in said acoustic chamber, said acoustic fill material having a low pass, low loss transfer function, wherein back-waves introduced into said acoustic chamber by said transducer experience delay with minimal attenuation before they exit said enclosure through said at least one port opening, said acoustic fill material substantially filling the entirety of the internal acoustic chamber of said enclosure between the sidewalls thereof and extending from about said transducer to a distance that substantially covers said one port opening.

18. The loudspeaker of claim 17 wherein said port openings are displaced behind the transducer by a distance approximately equal to the diameter of the transducer's cone diaphragm.

19. The loudspeaker of claim 18 wherein said port openings are configured to provide a symmetrical distribution of ports around said enclosure.

20. The loudspeaker of claim 19 wherein an elongated single port opening is provided in each sidewall of said enclosure.

21. The loudspeaker of claim 20 wherein said single port has rounded ends.

22. A loudspeaker with passive directional control at low frequencies comprising an enclosure having a front, a back and sidewalls, a transducer mounted to the front of said enclosure, said transducer having a diaphragm for producing acoustic energy from an electrical audio signal, said acoustic energy being produced as front-waves and back-waves, an acoustic chamber in said enclosure behind said transducer for receiving back-waves produced by said transducer, at least one port opening in each of the sidewalls of said enclosure through which acoustic energy in said acoustic chamber produced by said transducer can exit said enclosure, a means for providing a low loss acoustic resistance at each port opening, and an acoustic fill material that substantially fills the entirety of the internal acoustic chamber of said enclosure between the sidewalls thereof and that extends from about said transducer for a distance that substantially covers said at least one port opening, and having a maximum low-frequency attenuation through the material of no greater than approximately −2 dB, and a transfer function that approximates a first order low pass filter having a corner frequency of approximately 700 Hz.

23. The loudspeaker of claim 22 wherein said acoustic fill material is caged in the longitudinal direction in said enclosure substantially from one side wall of the enclosure to another to compress substantially the entirety of the acoustic fill material in said longitudinal direction.

24. The loudspeaker of claim 22 wherein said acoustic fill material is provided in a single block of acoustic fill material.

* * * * *